United States Patent [19]

Clegg

[11] Patent Number: 4,570,344

[45] Date of Patent: Feb. 18, 1986

[54] ELLIPSOGRAPH

[76] Inventor: John E. Clegg, 2320 Keystone Dr., Orlando, Fla. 32806

[21] Appl. No.: 678,939

[22] Filed: Dec. 6, 1984

[51] Int. Cl.[4] ..... B43L 11/04

[52] U.S. Cl. ..... 33/30.1; 33/30.4

[58] Field of Search ..... 33/27 R, 30 R, 30 D, 33/30 F, 30 G

[56] References Cited

U.S. PATENT DOCUMENTS

| | | | |
|---|---|---|---|
| 731,018 | 6/1903 | Carlton | 33/30 R |
| 1,304,494 | 5/1919 | McNeil | 33/30 R |
| 2,414,750 | 1/1947 | Loucks, Jr. | 33/27 R |
| 2,913,823 | 11/1959 | Robinson | 33/30 R |

FOREIGN PATENT DOCUMENTS

| | | | |
|---|---|---|---|
| 9085 | 8/1879 | Fed. Rep. of Germany | 33/30 D |
| 458115 | 8/1950 | Italy | 33/30 D |
| 146960 | 9/1954 | Sweden | 33/30 A |
| 114711 | 4/1926 | Switzerland | 33/30 D |

*Primary Examiner*—Richard R. Stearns

[57] ABSTRACT

A scriber arm mounted to two synchronized cranks, one of which defines the minor axis of the ellipse while the other defines the major axis.

1 Claim, 5 Drawing Figures

ELLIPSOGRAPH

BACKGROUND

Prior art includes the following inventions;

1. Ellipsograph, U.S. Pat. No. 731,018, June 16, 1903, by R. Carlton. This instrument has a scriber arm operated by a single crank.

2. Ellipsograph, U.S. Pat. No. 1,304,494, May 30, 1919, by J. McNeil. This instrument also features synchronized cranks.

3. Ellipsograph, U.S. Pat. No. 2,913,823, Nov. 24, 1959, by P. D. Robinson. This instrument also features synchronized cranks.

DRAWINGS

DESCRIPTION

Figure 1:
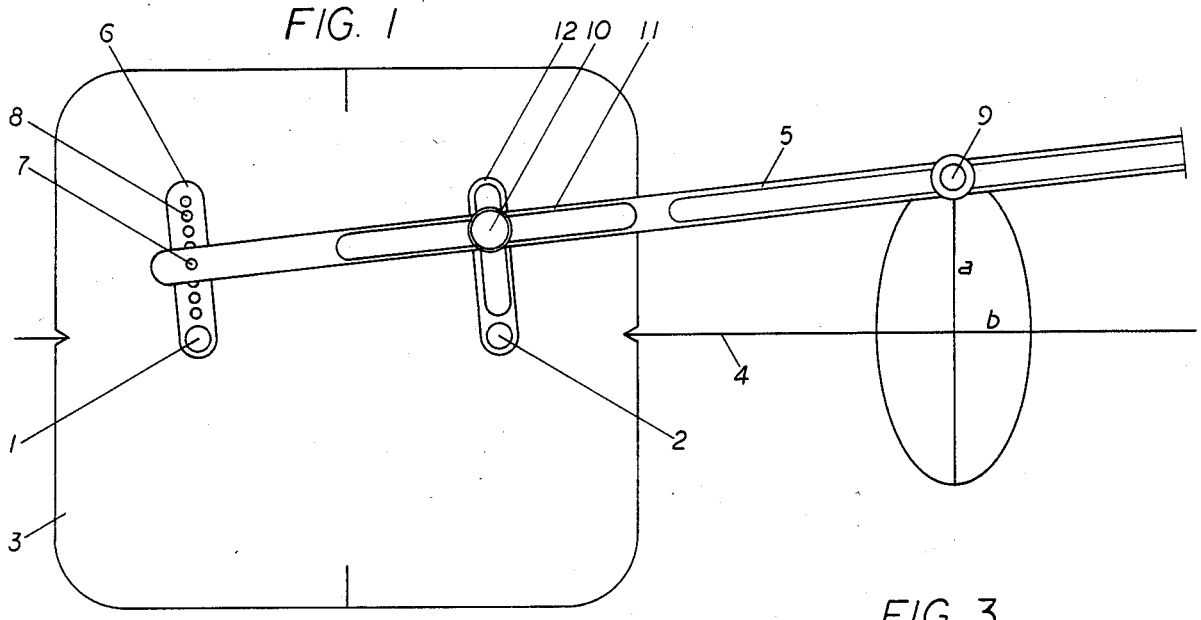
FIG. 1 is a plan view of the ellipsograph.

FIG. 1 is a plan view of the ellipsograph showing shafts 1 and 2 mounted in housing 3 and aligned on extended minor-axis line 4. Scriber arm 5 is attached at one end to crank 6 by pin 7 inserted in one of holes 8, with the distance between pin 7 and shaft 1 being equal to the minor axis of the ellipse to be drawn. Inscriber 9 is placed at the end of the major axis, and set screw 10, which slides in slotted section 11 of scriber arm 5, is tightened to slotted crank 12.

Figure 2:
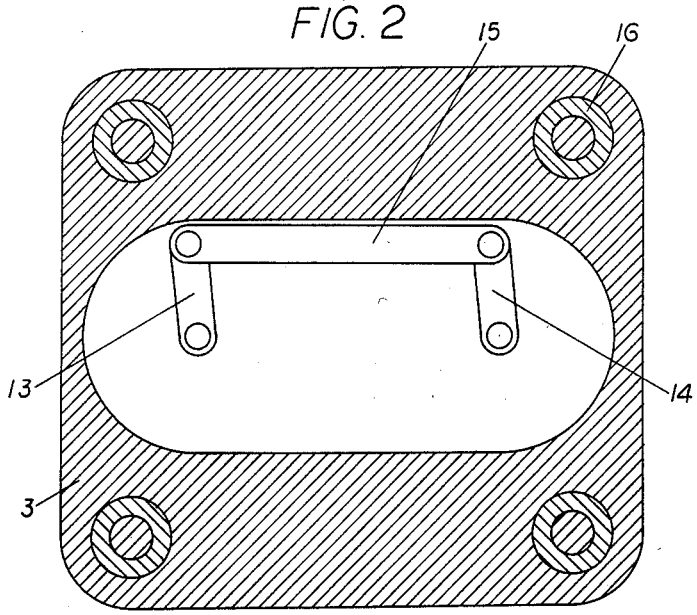
FIG. 2 is a cross section through the housing showing the synchronized cranks.

Cranks 6 and 12 are synchronized to revolve together by synchronized cranks 13 and 14 and connecting bar 15 in the base of the housing 3, as shown in FIG. 2.

The ellipsograph uses synchronized revolving and oscillating motions in drawing an ellipse. One end of scriber arm 5 revolves with crank 6 and defines the minor axis of the ellipse, while the slotted section 11 of scriber arm 5 oscillates on set screw 10 and defines the major axis. This suggests that the ellipse is a modified circle with an extended major axis and that the relationship to the cone is coincidental.

Figure 3:
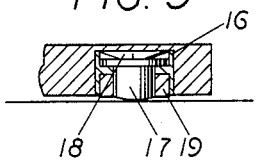
FIG. 3 is an elevation of an instrument riser.
Figure 4:
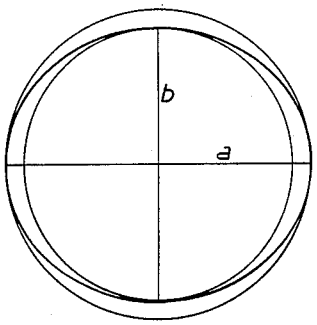
FIG. 4 is a 60° ellipse in standard position.

Instrument riser 16 of FIG. 3 is the means of securing a rigid support for the ellipsograph while the ellipse is being drawn. It eliminates the need of mounting the ellipsograph to the drafting table. It is disclosed in a copending application, and its operation is described below.

During alignment and adjustment of the ellipsograph on the drawing, the ellipsograph is supported by four posts 17 which raise the instrument to an elevated position and allow it to be moved freely on the drawing. When the instrument is properly positioned on the drawing, a slight downward pressure of the hand compresses slotted belleview springs 18 and retracts posts 17, lowering the housing 3 onto four annular rubber pads 19 which grip the surface of the drawing surface and hold the instrument steady while the ellipse is drawn.

Figure 5:
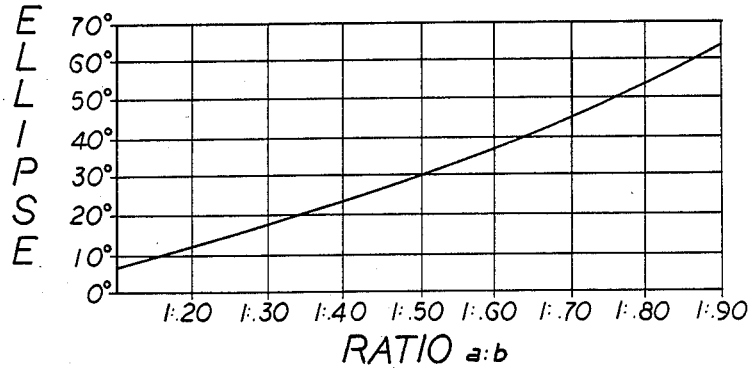
FIG. 5 is a graph of the degree-ratio line of the ellipse.

FIG. 5 is a graph of the degree-ratio line of ellipses. It can be used to determine the length of an axis when only the length of one axis and the degree of the ellipse are known.

I claim:

1. An ellipsograph comprising in general a mechanical instrument for drawing ellipses on a plane surface, and comprising in particular;

an elongate scriber arm (5) having a revolving end with a vertical pin (7) mounted therein, having a slotted middle section (11), and having a slotted end section with an inscriber (9) mounted to slide longitudinal therein, a rectangular housing (3) mounted above the plane surface, two vertical shafts (1,2) having upper ends and lower ends and being rotatably mounted in housing (3), two parallel synchronized cranks (13,14) having inner pivoting ends attached to the lower ends of shafts (1,2) so as to rotate therewith, and having outer revolving ends attached to opposite ends of a connecting bar (15) which serves as synchronizing means.

a crank (6) having an inner pivoting end attached to the upper end of shaft (1) so as to rotate therewith and having a series of holes (8) to accommodate vertical pin (7) of scriber arm (5), a crank (12) having a inner pivoting end attached to the upper end of shaft (2) so as to rotate therewith and having a slot in the middle and outer portions thereof, a set screw (10) engaging and lockable to the slot of crank (12) and engaging so as to slide longitudinally in the slotted middle section (11) of scriber arm (5).

* * * * *